US007546961B2

(12) United States Patent
Cristiani et al.

(10) Patent No.: US 7,546,961 B2
(45) **Date of Patent: *Jun. 16, 2009**

(54) FUEL INJECTOR WITH ELECTROMAGNETIC ACTUATOR

(75) Inventors: Marcello Cristiani, Imola (IT); Paolo Pasquali, Castelmaggiore (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/414,717

(22) Filed: Apr. 28, 2006

(65) Prior Publication Data

US 2006/0255185 A1 Nov. 16, 2006

(30) Foreign Application Priority Data

Apr. 29, 2005 (IT) ..... BO2005A0295

(51) Int. Cl.
*F02M 51/00* (2006.01)

(52) U.S. Cl. ..... 239/585.4; 239/456; 239/492; 239/533.7; 239/533.11; 239/585.1

(58) Field of Classification Search ..... 239/452, 239/453, 456, 492, 533.7, 533.11, 585.1, 239/585.3, 585.4, 580; 251/129.15, 129.16, 251/129.18, 285
See application file for complete search history.

(56) References Cited

U.S. PATENT DOCUMENTS 4,033,507 A * 7/1977 Fromel et al. ..... 239/453
4,783,009 A * 11/1988 Coates ..... 239/580
4,813,599 A * 3/1989 Greiner et al. ..... 239/456
4,844,339 A * 7/1989 Sayer et al. ..... 239/585.1
4,917,352 A 4/1990 Hauet et al.
5,551,634 A 9/1996 Raab et al.
6,042,028 A * 3/2000 Xu ..... 239/585.1
6,170,767 B1 1/2001 Herold et al.
6,367,769 B1 4/2002 Reiter (Continued)

FOREIGN PATENT DOCUMENTS

DE 19849956 4/2000

(Continued)

OTHER PUBLICATIONS

European Search Report based on corresponding PCT application # 06113246.0-2311 dated Sep. 1, 2006.

(Continued)

*Primary Examiner*—Steven J. Ganey
(74) *Attorney, Agent, or Firm*—Ohlandt, Greeley, Ruggiero & Perle, L.L.P.

(57) ABSTRACT

A fuel injector equipped with an injection valve comprising a mobile plunger ending with a sealing head; a support body having a tubular shape and comprising a feed channel; and a sealing body, in which is defined a valve seat of the injection valve; the sealing head is of a frustoconical shape, is arranged externally relative to the guide element, is thrust by a spring against said guide element in a direction contrary to the direction of feed of the fuel; the valve seat has a frustoconical shape which is a negative reproduction of the frustoconical shape of the sealing head in order to impart an internally hollow conical shape to the injected fuel.

11 Claims, 3 Drawing Sheets

U.S. PATENT DOCUMENTS

| | | | | |
|---|---|---|---|---|
| 6,431,472 | B1 | 8/2002 | Tian et al. | |
| 6,435,429 | B1 | 8/2002 | Eichendorf et al. | |
| 6,732,949 | B1 | 5/2004 | Harn Dorf | |
| 7,204,434 | B2 * | 4/2007 | Pasquali et al. | 239/456 |
| 2002/0079388 | A1 | 6/2002 | Tian et al. | |
| 2003/0102386 | A1 | 6/2003 | Sebastian et al. | |
| 2003/0106946 | A1 | 6/2003 | Dantes et al. | |
| 2005/0040258 | A1 | 2/2005 | Dallmeyer et al. | |

FOREIGN PATENT DOCUMENTS

| | | |
|---|---|---|
| EP | 1041272 | 10/2000 |
| GB | 2349421 | 11/2000 |
| JP | 57146049 | 9/1982 |
| JP | 62255569 | 11/1987 |
| JP | 3043659 | 2/1991 |
| JP | 3050378 | 3/1991 |
| WO | WO03/072931 | 9/2003 |

OTHER PUBLICATIONS

European Search Report dated Nov. 24, 2005 based on EP application No. EP05425435.

* cited by examiner

FUEL INJECTOR WITH ELECTROMAGNETIC ACTUATOR

The present invention relates to a fuel injector with an electromagnetic actuator.

The following explanations will make explicit reference, without consequently restricting the general scope thereof, to an injector with an electromagnetic actuator for direct fuel injection.

BACKGROUND OF THE INVENTION

An electromagnetic fuel injector comprises a cylindrical tubular body having a central feed channel which performs the function of a fuel duct and ends with an injection jet controlled by an injection valve operated by an electromagnetic actuator. The injection valve is provided with a plunger, which is rigidly connected to a mobile armature of the electromagnetic actuator in order to be displaced by the action of said electromagnetic actuator between a closed position and an open position of the injection jet against the action of a spring which tends to hold the plunger in the closed position. The plunger ends with a sealing head which, in the closed position, is thrust by the spring against a valve seat of the injection valve in order to prevent the fuel from escaping. In general, the sealing head is arranged within the fuel duct; consequently, in order to change over from the closed position to the open position of the injection valve, the sealing head is displaced in a direction contrary to the direction of feed of the fuel.

Electromagnetic fuel injectors of the above-described type are simple and economic to produce and exhibit a good cost/performance ratio. However, such injectors do not ensure a high level of precision and of stability in directing fuel injection and such injectors are accordingly unsuitable for use in "spray-guided" engines, in which the fuel must be injected with a very high level of precision in the vicinity of the spark plug; indeed, in this kind of application, an error of less than one millimeter in the direction of the stream of fuel may result in wetting of the spark plug electrodes, so seriously compromising combustion.

JP3050378 discloses an injector for directly injecting fuel into a cylinder of a two-cycle engine; the injector is provided with a two-piece structured valve member in a housing for guiding freely movably a first valve member provided with a valve head at the tip along the axis by a guide member and a sheet member. In this case, a cone-shaped fuel injection port expanding outward is formed at the tip of the sheet member; in addition, a fuel measuring unit for giving a constant flow path cross-sectional area corresponding to difference between the cross-sectional area of a fuel path and the cross-sectional area of the valve member in the flowing direction over specified length and regulating fuel injection amount per injection is formed before the injection port by providing a neck at the foot of the valve head.

JP62255569 discloses a fuel injection valve; first and second stoppers serving as stoppers on a moving side are made abutment against a spacer serving as a stopper on a fixed side for keeping an operating stroke of a needle valve constant. When an amount of fuel injection is to be regulated, a screw serving as a regulating unit is move upwardly and downwardly while fuel is injected for thereby determining the position of a valve case with respect to a body so as to regulate the operating stroke; at the time, the urging force of a regulating spring permits the valve case to move together with the screw and the spring permits the needle valve to move together with the valve case. When a position of the valve case corresponding to a prescribed injection amount is reached, the screw is fixed to the opening lower edge of a body by spot welding.

JP3043659 discloses an injector directly injecting a fuel into the cylinder of a two-cycle engine; the injector has a valve member divided into first and second valve members, and the first valve member is guided by a guide member and a sheet member and held in such a manner as to be axially movable, and a valve head is provided on its top end. The second valve member is projected into the solenoid of an electromagnetic driving means, and an armature is fixed to its rear end part. In this case, a return fuel passage extending from a bypass passage forming a part of an injection fuel passage extending from a fuel feed port to a fuel injection port provided on the sheet member inner end side to the fuel tank side is formed.

SUMMARY OF THE INVENTION

The object of the present invention is to provide a fuel injector with an electromagnetic actuator which does not exhibit the above-stated disadvantages and, in particular, is simple and economic to produce.

The present invention provides a fuel injector with an electromagnetic actuator as recited in the attached claims.

BRIEF DESCRIPTION OF THE DRAWINGS

The present invention will now be described with reference to the attached drawings, which illustrate a non-limiting embodiment of the invention, in which.

DETAILED DESCRIPTION OF THE INVENTION

Figure 1:
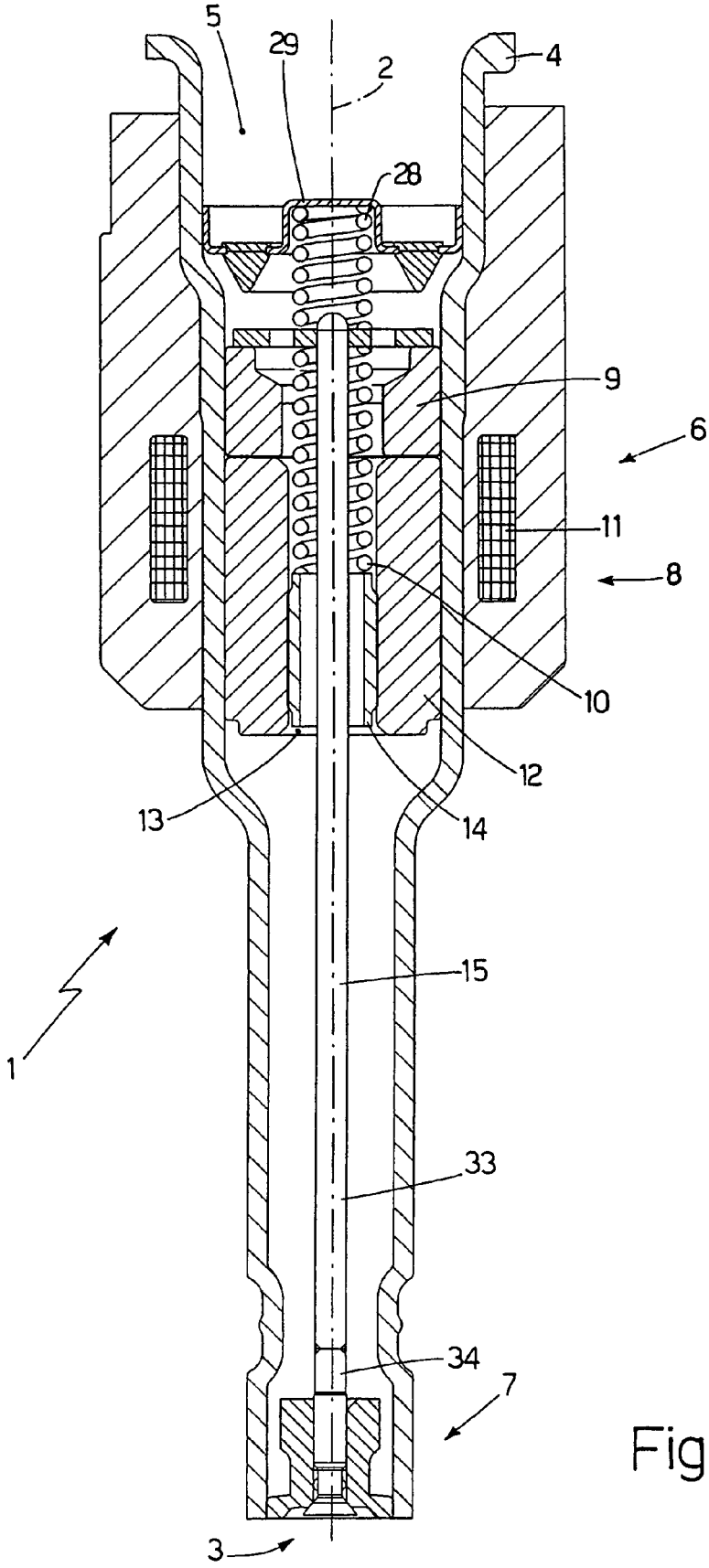
FIG. 1 is a schematic cross-section with portions removed for clarity's sake of a fuel injector produced in accordance with the present invention.

In FIG. 1, 1 denotes the overall fuel injector which exhibits a substantially cylindrical symmetry around a longitudinal axis 2 and is capable of being operated to inject fuel from an injection jet 3 which opens directly into an explosion chamber (not shown) of a cylinder. The injector 1 comprises a monolithic support body 4, which is of a cylindrical tubular shape of variable cross-section along the longitudinal axis 2 and comprises a feed channel 5 extending over the entire length of said support body 4 in order to supply the fuel under pressure towards the injection jet 3. The support body 4 accommodates an electromagnetic actuator 6 at the level of an upper portion of said support body and an injection valve 7 at the level of a lower portion of said support body; in operation, the injection valve 7 is actuated by the electromagnetic actuator 6 in order to control the flow of fuel through the injection jet 3, which is located at the level of said injection valve 7.

The electromagnetic actuator 6 comprises an electromagnet 8, which is accommodated in a fixed position within the support body 4 and, when energised, is capable of displacing an armature 9 of ferromagnetic material along the axis 2 from a closed position into an open position of the injection valve 7 against the action of a main spring 10 which tends to hold the armature 9 in the closed position of the injection valve 7. In particular, the electromagnet 8 comprises a coil 11, which is electrically supplied by an electronic control unit (not shown) and is accommodated externally relative to the support body 4, and a magnetic armature 12, which is accommodated within the support body 4 and exhibits a central hole 13 in order to allow the fuel to flow towards the injection jet 3. Within the central hole 13 of the magnetic armature 12, an abutment body 14 is located in a fixed position, which body is of a tubular cylindrical shape (optionally open along a generatrix) in order to allow the fuel to flow towards the injection jet 3 and is capable of holding the main spring 10 compressed against the armature 9.

The armature 9 is part of a mobile assembly, which moreover comprises a poppet or plunger 15 having an upper portion integral with the armature 9 and a lower portion which cooperates with a valve seat 16 (shown in FIG. 2) of the injection valve 7 in order, in known manner, to control the flow of fuel through the injection jet 3.

Figure 2:
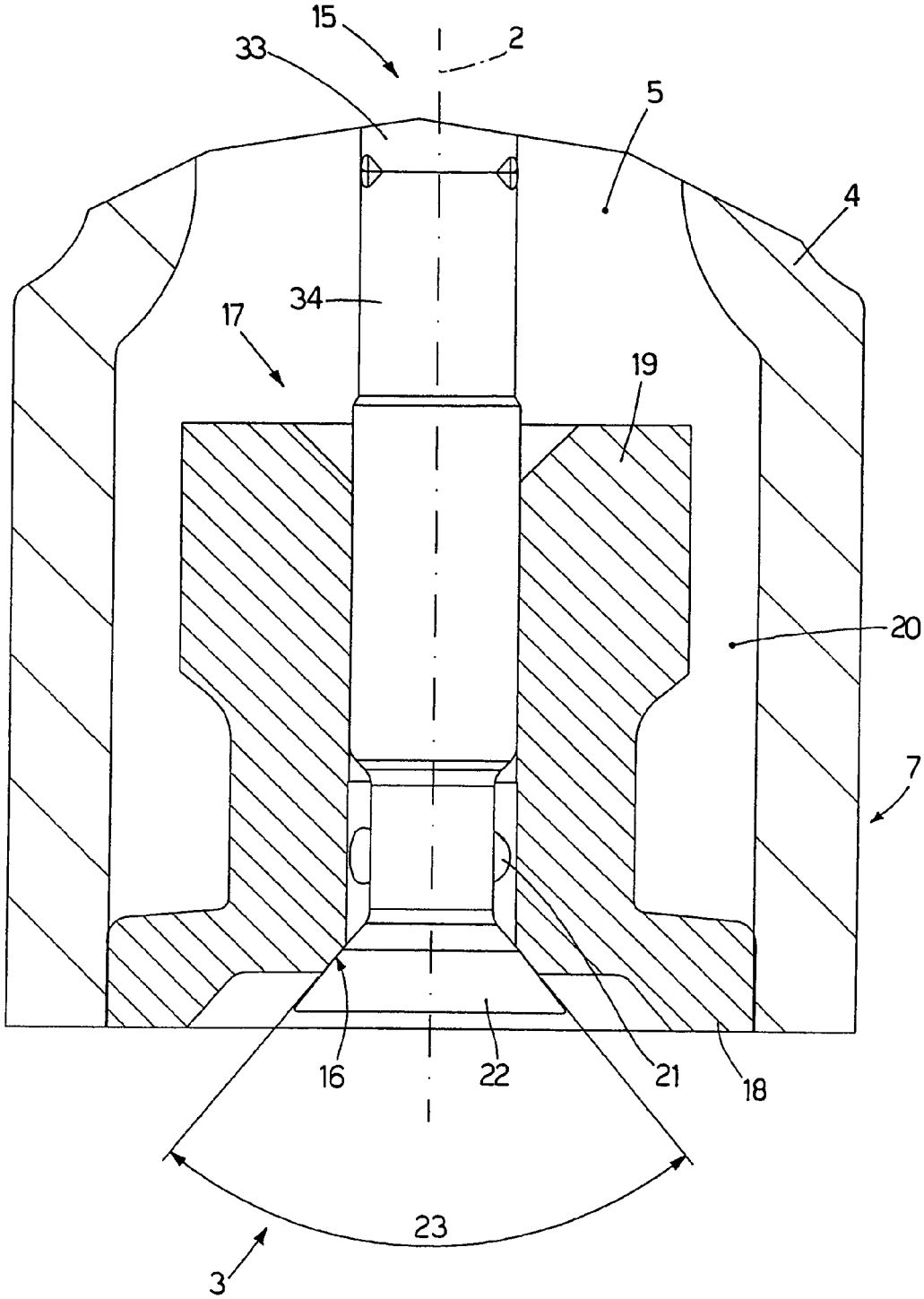
FIG. 2 shows an enlarged view of an injection valve of the injector of FIG. 1.

As shown in FIG. 2, the valve seat 16 is of a frustoconical shape and is defined by a sealing body 17, which is monolithic and comprises a disk-shaped plug element 18, which tightly seals the feed channel 5 of the support body 4 at the bottom and is passed through by the injection jet 3. A guide element 19 rises from the plug element 18, which guide element is tubular in shape, accommodates within it the plunger 15 in order to define a lower guide for said plunger 15 and has an external diameter which is smaller than the internal diameter of the feed channel 5 of the support body 4, in such a manner as to define an external annular channel 20 through which the fuel under pressure can flow.

According to another embodiment which is not shown, the guide element 19 has at the top a diameter equal to the internal diameter of the feed channel 5 of the support body 4; openings (typically two or four distributed symmetrically) are milled in the upper part of the guide element 19 in order to supply fuel to the annular channel 20.

In the lower part of the guide element 19 are located four through-holes 21 (only two of which are shown in FIG. 2), which open towards the valve seat 16 in order to permit fuel under pressure to flow towards said valve seat 16. The through-holes 21 are preferably arranged offset relative to the longitudinal axis 2 in such a manner as not to converge towards said longitudinal axis 2 and so as to impart when in operation a swirling flow to the respective streams of fuel; alternatively, the through-holes 21 may converge towards the longitudinal axis 2. As shown in FIG. 2, the holes 21 form an angle of 90° with the longitudinal axis 2; according to another embodiment which is not shown, the holes 21 are inclined and form an angle generally of between 60° and 80° with the longitudinal axis 2.

The plunger 15 ends with a sealing head 22 of frustoconical shape, which is capable of resting in sealing manner against the valve seat 16, which is of a frustoconical shape and is a negative reproduction of the frustoconical shape of said sealing head 22. It is important to note that the sealing head 22 is arranged externally relative to the guide element 19 and is thrust by the main spring 10 against said guide element 19; consequently, in order to change over from the closed position to the open position of the injection valve 7, the sealing head 22 is displaced downwards along the longitudinal axis 2, i.e. in a direction which is in accordance with the direction of feed of the fuel.

In the open position of the injection valve 7, the sealing head 22 is separated from the valve seat 16, so creating an opening which permits passage of the fuel of a circular, ring-shaped section and a frustoconical shape; as a result, the fuel which is injected through the injection jet 3 exhibits on exit an internally hollow conical shape having an aperture angle which is substantially identical to the aperture angle 23 of the sealing head 22 (exactly matching the aperture angle of the valve seat 16).

Figure 3:
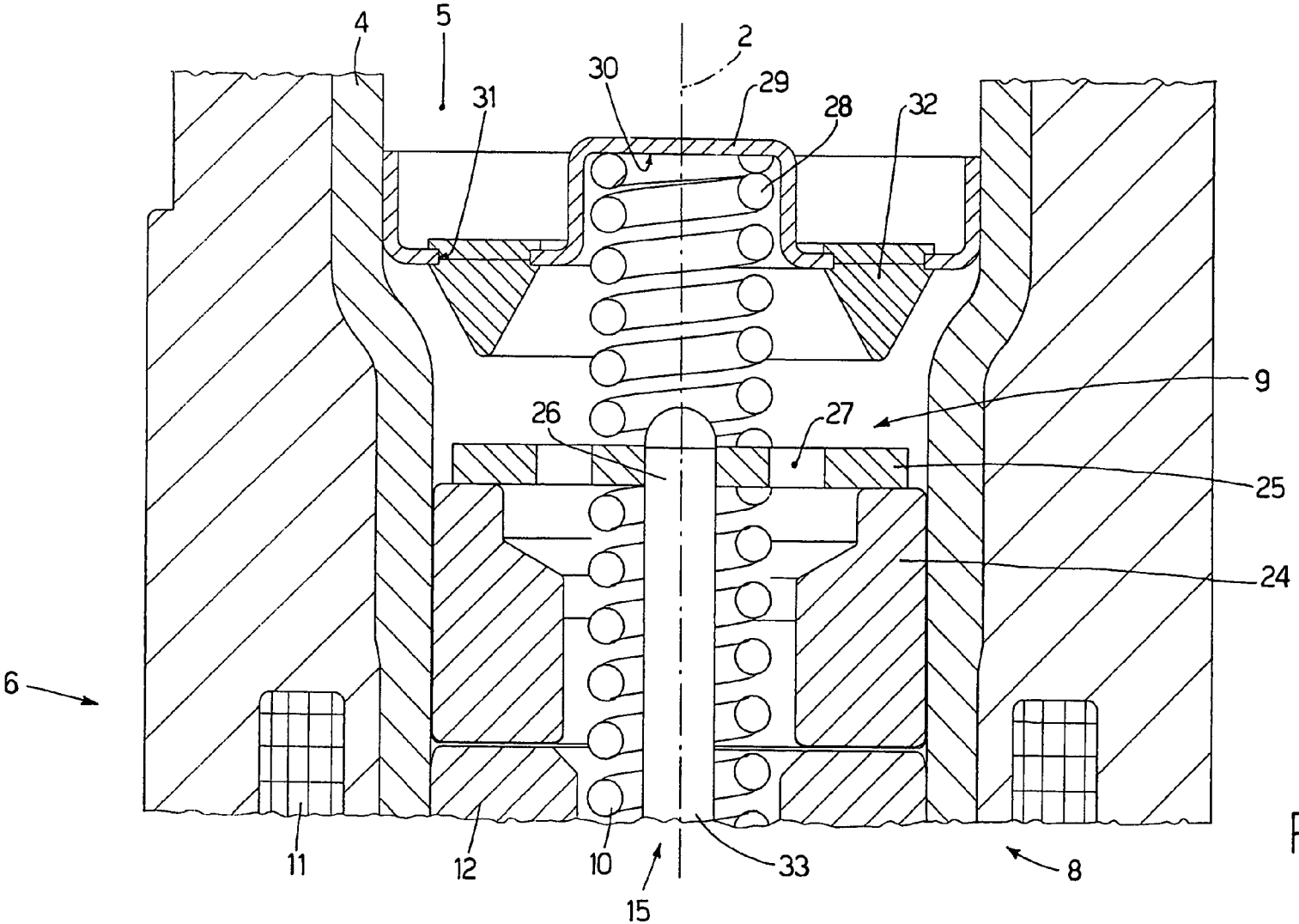
FIG. 3 shows an enlarged view of an armature of an electromagnetic actuator of the injector of FIG. 1.

As shown in FIG. 3, the armature 9 comprises an annular element 24 and a discoidal element 25 which closes the annular element 24 at the top and has a central through-hole 26 capable of receiving an upper portion of the plunger 15 and a plurality of peripheral through-holes 27 (only two of which are shown in FIG. 1) capable of permitting fuel to flow towards the injection jet 3. A central portion of the discoidal element 25 is appropriately shaped to so as to accommodate an upper end of the main spring 10 and hold it in position. Preferably, the plunger 15 is firmly connected with the discoidal element 25 of the armature 9 by means of an annular weld.

The annular element 24 of the armature 9 has an external diameter substantially identical to the internal diameter of the corresponding portion of the feed channel 5 of the support body 4; in this manner, the armature 9 can slide relative to the support body 4 along the longitudinal axis 2, but, relative to the support body 4, cannot move in any way transversely to the longitudinal axis 2. Since the plunger 15 is rigidly connected to the armature 5, it is clear that the armature 9 also performs the function of guiding the top of the plunger 15; as a consequence, the plunger 15 is guided at the top by the armature 9 and at the bottom by the guide element 19.

A further calibration spring 28 is also provided, which is compressed between the armature 9 and an abutment body 29 located in a fixed position within the support body 4; in particular, the calibration spring 28 has an upper end resting against a lower wall of the abutment body 29 and a lower end resting against an upper wall of the discoidal element 25 of the armature 9 on the opposite side relative to the main spring 10. The calibration spring 28 exerts on the armature 9 a resilient force which is oriented in the opposite direction to the resilient force of the main spring 10; during installation of the injector 1, the position of the abutment body 29 is adjusted in such a manner as consequently to adjust the resilient force generated by the calibration spring 28 in order to calibrate the overall resilient thrust acting on the armature 9.

According to a preferred embodiment shown in FIG. 3, the abutment body 29 is of a circular shape with a central portion in which there is defined a seat 30 for accommodating the calibration spring 28 and a peripheral portion in which are located a plurality of through-holes 31 (only two of which are shown in FIG. 3) in order to allow the fuel to flow towards the injection jet 3. Preferably, each through-hole 31 is coupled to a filtration element 32, which has the function of retaining any residues or impurities present in the fuel.

As shown in FIG. 1, the plunger 15 is made up of an upper part 33, which is integral with the armature 9, and a lower part 34, which supports the sealing head 22; the two parts 33 and 34 of the plunger 15 are joined to one another by means of a weld. This solution makes it possible to limit machining costs, in that only the lower part 34 which supports the sealing head 22 is subjected to precision machining, while the upper part 33 is more roughly machined.

In operation, when the electromagnet 8 is deenergised, the armature 9 is not attracted by the magnetic armature 12 and the resilient force of the main spring 10 thrusts the armature 9, together with the plunger 15, upwards; in this situation, the sealing head 22 of the plunger 15 is pressed against the valve seat 16 of the injection valve 7, preventing the fuel from escaping. When the electromagnet 8 is energised, the armature 9 is magnetically attracted by the magnetic armature 12 against the resilient force of the main spring 10 and the armature 9, together with the plunger 15, is displaced downwards until it comes into contact with said magnetic armature 12; in this situation, the sealing head 22 of the plunger 15 is lowered relative to the valve seat 16 of the injection valve 7 and the fuel under pressure can flow through the injection jet 3.

As stated previously, the four through-holes 21 which open towards the valve seat 16 are preferably arranged offset relative to the longitudinal axis 2 in such a manner as not to converge towards said longitudinal axis 2 and so as to impart when in operation a swirling flow to the respective streams of fuel. Such swirling flow of the fuel immediately upstream of the valve seat 16 makes it possible to achieve homogeneous and uniform distribution of the fuel around the entire circumference, avoiding the formation of "empty" zones, i.e. zones in which a reduced quantity of fuel is present.

When the sealing head 22 of the plunger 15 is raised relative to the valve seat 16, the fuel reaches the injection jet 3 through the external annular channel 20 and subsequently through the four through-holes 21; in other words, when the sealing head 22 of the plunger 15 is raised relative to the valve seat 16, the fuel reaches the injection jet 3, wetting the entire external lateral surface of the guide element 19. In this manner, the guide element 19 is constantly cooled by the fuel, which is at a relatively low temperature; this cooling effect of the guide element 19 is transmitted to the entire sealing body 17 (which is monolithic) and is thus also transmitted to the plug element 18 in which the injection jet 3 is located. In other words, the guide element 19 which is constantly wetted internally and externally by the fuel acts as a radiator for dissipating heat received from outside and present in the plug element 18.

Experimental testing has demonstrated that the reduction in the operating temperature of the plug element 18 results in a considerable reduction in the formation of deposits on the external surface of the plug element 18 and thus in the vicinity of the valve seat 16. Thanks to said effect of reduced formation of deposits in the vicinity of the valve seat 16, the above-described injector 1 has a very long service life.

The above-described injector 1 exhibits numerous advantages, in that it is simple and economic to produce, it enables accurate calibration of the flow rate of fuel and, above all, exhibits high levels of precision and stability in directing the fuel injection. As a consequence, the above-described injector 1 is particularly suitable for use in a "spray-guided" engine, in which the fuel must be injected with very high precision in the vicinity of the spark plug.

The invention claimed is:

1. A fuel injector (1) comprising:

an injection valve (7) comprising an injection jet (3) and provided with a plunger (15), which is mobile in order to control the flow of fuel and ends with a sealing head (22);

an electromagnetic actuator (6) capable of displacing the plunger (15) between a closed position and an open position of the injection valve (7) and comprising a coil (11), a fixed magnetic armature (12), and an armature (9), which is attracted magnetically by the magnetic armature (12) and is mechanically connected to the plunger (15);

a main spring (10) for holding the plunger (15) in the closed position of the injection valve (7) and having one end resting against the armature (9);

a calibration spring (28), which comprises one end that rests against the armature (9) on the opposite side to the main spring (10);

a support body (4) having a tubular shape and comprising a feed channel (5) within which are arranged the plunger (15) and the spring (10); and a plug body (17), in which is defined a valve seat (16) of the injection valve (7) in which the sealing head (22) engages; the plug body (17) comprises a disk-shaped plug element (18) which tightly seals the feed channel (5) at the bottom, and a guide element (19), which rises from the plug element (18), is tubular in shape, and accommodates within it the plunger (15);

wherein the sealing head (22)is of a frustoconical shape, is arranged externally relative to the guide element (19) and is thrust by the main spring (10) against said guide element (19) in a direction contrary to the direction of feed of the fuel; the valve seat (16) has a frustoconical shape which is a negative reproduction of the frustoconical shape of the sealing head (22) such that, in the open position of the injection valve (7), the sealing head (22) is separated from the valve seat (16), so creating an opening which permits passage of the fuel of a circular, ring-shaped section and a frustoconical shape in order to impart an internally hollow conical shape to the injected fuel;

wherein the armature (9) comprises an annular element (24) and a discoidal element (25) which closes the annular element (24) at the top, has a central through-hole (26) capable of receiving an upper portion of the plunger (15), has a plurality of peripheral through-holes (27) capable of permitting fuel to flow towards the injection jet (3), has an upper wall against which rest one end of the calibration spring (28), and has a lower wall opposite to the upper wall against which rest one end of the main spring (10).

2. An injector (1) according to claim 1, wherein the guide element (19) has at least in part an external diameter which is smaller than the internal diameter of the feed channel (5) in order to define an external channel (20) for the fuel; in the lower part of the guide element (19) are located a number of through-holes (21) opening towards the valve seat (16).

3. An injector (1) according to claim 2, wherein the through-holes (21) of the guide element (19) form an angle of between 60° and 80° with a longitudinal axis (2) of the injector (1).

4. An injector (1) according to claim 1, wherein the through-holes (21) form an angle of 90° with a longitudinal axis (2) of the injector (1).

5. An injector (1) according to claim 2, wherein the through-holes (21) are arranged offset relative to a longitudinal axis (2) of the injector (1) in such a manner as not to converge towards said longitudinal axis (2) and so as to impart when in operation a swirling flow to the respective streams of fuel.

6. An injector (1) according to claim 1, wherein the guide element (19) defines a lower guide for the plunger (15).

7. An injector (1) according to claim 1, wherein the calibration spring (28) is compressed between the armature (9) and an abutment body (29) located in a fixed position within the support body (4); the position of the abutment body (29) is adjustable during installation in such a manner as consequently to adjust the resilient force generated by the calibration spring (28) in order to calibrate the overall resilient thrust acting on the armature (9).

8. An injector (1) according to claim 7, wherein the abutment body (29) comprises at least one through-hole (31) in order to allow the fuel to flow towards the injection jet (3), and a filtration element (32) coupled to the through-hole (31).

9. An injector (1) according to claim 8, wherein the abutment body (29) is of a circular shape with a central portion in which there is defined a seat (30) for accommodating the calibration spring (28) and a peripheral portion in which are located a plurality of through-holes (31) in order to allow the fuel to flow towards the injection jet (3).

10. An injector (1) according to claim 9, wherein a filtration element (32) is coupled to each through-hole (31), which filtration element has the function of retaining any residues or impurities present in the fuel.

11. An injector (1) according to claim 1, wherein the plunger (15) is made up of an upper part (33), which is integral with the armature (9) of the electromagnetic actuator (6), and a lower part (34), which supports the sealing head (22) and is joined to the upper part (33) by means of a weld.

* * * * *